United States Patent [19]

Olson

[11] Patent Number: 4,964,188

[45] Date of Patent: Oct. 23, 1990

[54] CLEAN UP DEVICE

[76] Inventor: Mary L. Olson, 1147 Ivyhill Dr., Mendota Heights, Minn. 55118

[21] Appl. No.: 376,415

[22] Filed: Jul. 6, 1989

[51] Int. Cl.[5] ..... A47L 13/18

[52] U.S. Cl. ..... 15/227; 2/159; 2/160; 294/1.3

[58] Field of Search ..... 15/227; 294/1.3, 25; 2/158, 159, 160, 164, 168

[56] References Cited

U.S. PATENT DOCUMENTS

| | | | |
|---|---|---|---|
| 4,347,931 | 9/1982 | Ginger et al. | 15/227 X |
| 4,645,251 | 2/1987 | Jacobs | 294/1.3 |
| 4,677,697 | 7/1987 | Hayes | 2/159 |
| 4,741,565 | 5/1988 | Bagg | 294/1.3 |
| 4,768,818 | 9/1988 | Kolic | 294/1.3 |
| 4,788,733 | 12/1988 | Lerner | 15/104.94 |
| 4,845,781 | 7/1989 | Strickland et al. | 294/1.3 X |
| 4,902,283 | 2/1990 | Rojko et al. | 294/1.3 X |

FOREIGN PATENT DOCUMENTS

| | | | |
|---|---|---|---|
| 284487 | 5/1915 | Fed. Rep. of Germany | 15/227 |
| 1200067 | 6/1959 | France | 15/227 |
| 2333482 | 7/1977 | France | 15/227 |

*Primary Examiner*—Chris K. Moore

*Attorney, Agent, or Firm*—Merchant, Gould, Smith, Welter & Schmidt

[57] ABSTRACT

The invention relates to a clean up bag, more particularly to a plastic bag that has a plastic glove which is heat sealed to one interior side of the bag. The glove has two thumbs so that it may be used by either left handed or right handed individuals. There is a padding of fibrous material on the outside of the bag which absorbs any liquid surrounding or contained in the specimen to be picked up. Additionally, the padding prevents the user from feeling the texture or heat of the specimen. The bag also has a draw string closure on the top which pulls from either side and has pleats on each side of the bag so that it may be easily turned inside out. Finally, the bag is cloudy or opaque so that the user cannot see the contents.

5 Claims, 2 Drawing Sheets

CLEAN UP DEVICE

TECHNICAL FIELD OF THE INVENTION

This invention relates to clean up devices, and specifically, a plastic bag having a glove heat sealed to the interior side of the bag and absorbent material on the outside of the bag, which is specifically designed to pick up a specimen, wherein the bag can be turned inside out to facilitate disposal of the specimen.

BACKGROUND OF THE INVENTION

Animals, like humans, need exercise to stay in good health. Many pet owners walk or jog with their dog around their neighborhood and various public parks. The pet owners, however, are often faced with the problem of what to do with their pet's excrement. Many municipalities have begun adopting ordinances which regulate the disposal of pet excrement and require the owner to clean up any droppings. Some pet owners carry some type of a shovel and a bag. Others use a scissor-like scoop. These inventions have, however, shown some disadvantages. Some are difficult to use while holding onto the pet leash or have insufficient structural design to adequately retain the pet feces so that they do not fall onto the ground after being scooped up. Other problems include that they are burdensome and heavyweight. It is a great inconvenience for pet owners to walk their dog while carrying a scoop or shovel. Thus, there is the need for a disposal system which is both lightweight and easy to use.

Several types of disposal clean up bags have been developed. These bags are often difficult to operate. When the hand is inside the bag, it is difficult to get a proper grip on the excrement. Often the excrement slips around and cannot be properly picked up without additional manipulation from a free hand or by using another object such as a twig. Very often the user contaminates his or her own hands in using these clean up bags. Further, there is often moisture associated with excrement. This moisture makes it even more difficult to properly clean up the excrement. Finally, these bags are often unpleasant to use because the user can feel the heat and texture of the excrement.

In contrast to the prior systems, the present invention includes a glove which is heat sealed to the inside of the plastic bag. This glove allows easy manipulation of the bag so that the excrement may be easily picked up. The glove prevents the bag from slipping around on the hand. Further, the outside of the bag has padding material mounted to the surface of the bag. This padding material helps absorb any moisture contained in the excrement so that the excrement does not slip around when the user is picking it up. Further, the padding serves as an insulator so that the user does not feel the texture or heat of the excrement.

These and other advantages of the invention over the prior clean up devices will become more apparent after reading the description and claims which follow.

SUMMARY OF THE INVENTION

The invention relates to a clean up device, more particularly to a plastic bag that has a plastic glove which is heat sealed to one interior side of the bag. The glove has two thumbs so it may be used by either left handed or right handed individuals. There is padding fabric attached to the outside of the bag which absorbs any liquid surrounding or contained in the specimen to be picked up. Additionally, the padding prevents the user from feeling the texture or heat of the specimen. The bag also has a draw string closure on the top which pulls from either side and pleats on each side of the bag so that it may be easily turned inside out. Finally, the bag is opaque so the user cannot see the contents.

In operation, the user places his or her hand inside the plastic glove which is inside the bag and grasps the specimen. The padding absorbs the moisture. The user then turns the bag inside out so the specimen is contained inside the bag. Finally, the draw strings are pulled tight so that the bag is closed. The user may carry the specimen, which is neatly contained within the bag, or the user may dispose of the bag containing the specimen at the first convenient location.

The preferred embodiment relates to dogs; however, this invention could have other applications such as in hospitals and in industrial clean ups where the absorbent padding becomes particularly significant for glass splinters, liquids, and possibly caustic or toxic substances as well.

DETAILED DESCRIPTION OF THE INVENTION

Figure 1:
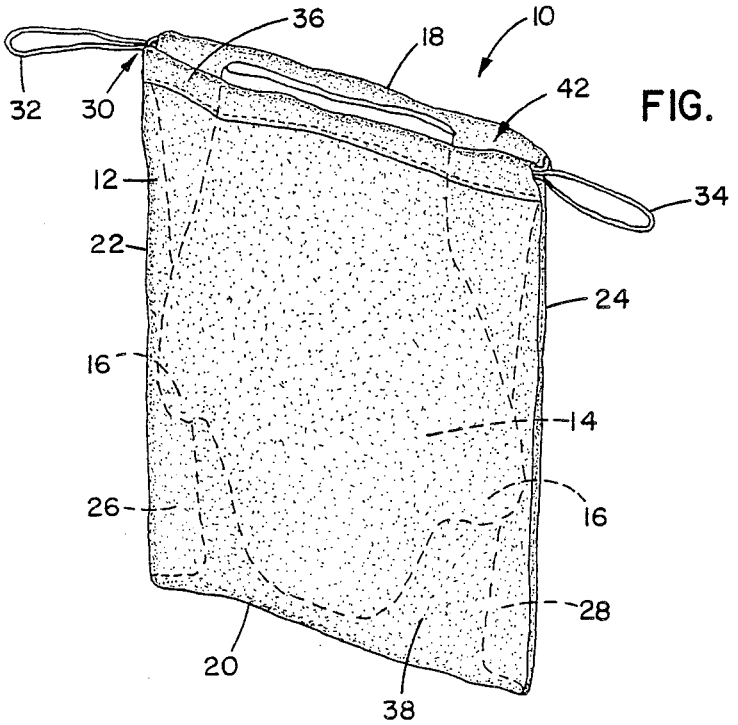
FIG. 1 is a schematic view of the clean up bag constructed in accordance with the present invention.

Referring to FIG. 1, the present invention consists of a clean up device 10 constructed from a bag 12 and a glove 14 for use in cleaning up and disposing of animal feces or other specimens (not shown).

Preferably, the glove 14 is sized and shaped to receive an adult's hand and has two thumbs 16 so that the glove may be used by either left handed or right handed individuals. In the preferred embodiment, the glove is constructed from some type of heat-sealable plastic, but those skilled in the art will recognize that other materials may be used.

The bag 12 is generally rectangular in shape and sized to receive the glove 14. In the preferred embodiment, the bag is constructed from heat-sealable plastic, similar to that from which the glove is constructed. Preferably, the plastic is opaque so when the bag is turned inside out, the contents are not visible. Again, those skilled in the art will appreciate that alternative materials may be used.

The bag 12 has a top 18 and a bottom 20 and two opposing sides 22 and 24 which are constructed so that there is a pleat, 26 and 28 respectively, on each side of the bag 12. Each pleat longitudinally extends from the top 18 of the bag 12 to the bottom 20 of the bag 12. As described in more detail below, these pleats 26 and 28 allow the bag 12 to be easily turned inside out so that the excrement is contained in the interior of the clean up device 10.

Figure 3:
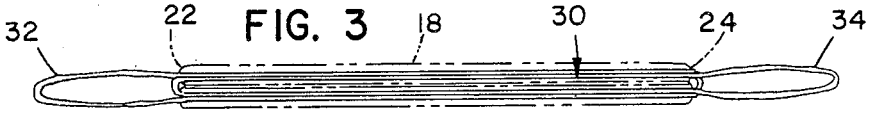
FIG. 3 is a top view of the clean up bag showing the drawstring arrangement.
Figure 2:
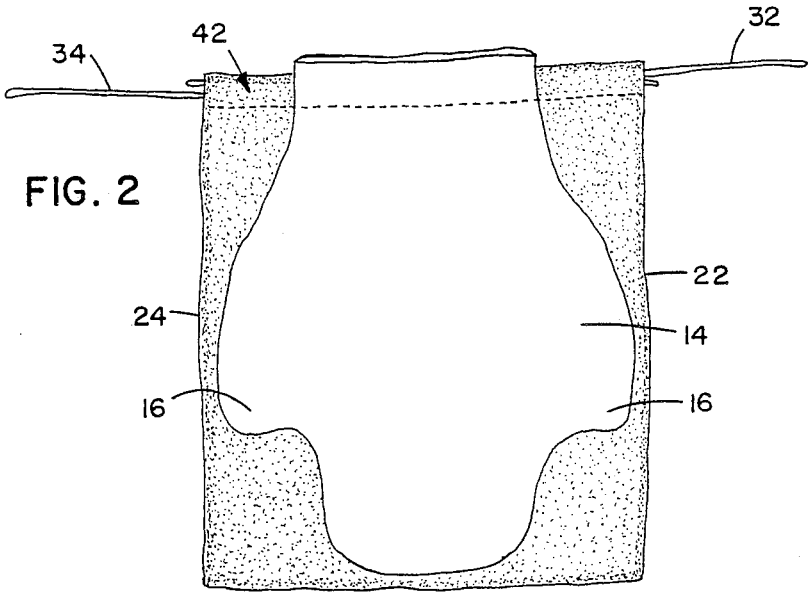
FIG. 2 is a schematic view of the clean up bag after being turned inside out.
Figure 5:
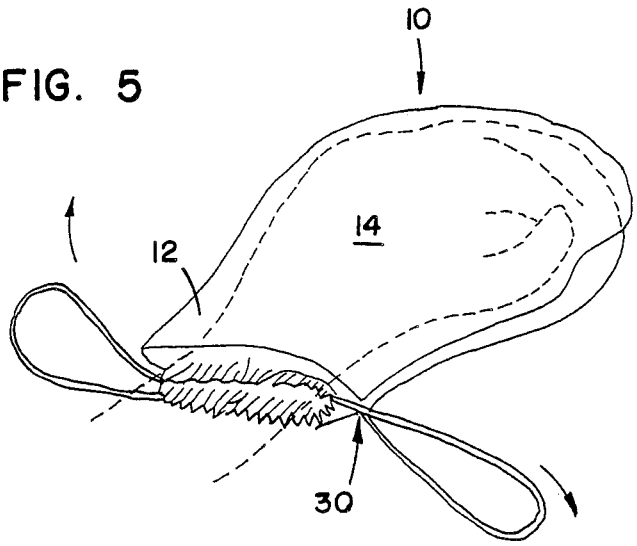
FIG. 5 is a schematic view of the clean up bag after it has been turned inside out.

Further, the bag 12 has a gathering type cord arrangement 30, shown in FIG. 3, which may be pulled from either side to secure the contents inside of the bag.

Preferably, this gathering arrangement 30 consists of a first 32 and a second 34 draw string cord. Both draw string cords 32 and 34 are located in a sleeve 36 along the top 18 of the bag 12. The sleeve 36 is formed by folding over a small portion of the bag near the top 18 and heat sealing the folded edge thereby forming the sleeve. The draw string cords 32 and 34 are both placed in the sleeve 36 so that the first cord 32 may be drawn closed from side 22 of the bag while the second cord 34 may be drawn closed from side 24 of the bag.

Figure 4:
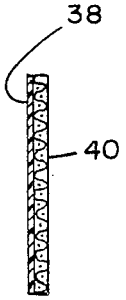
FIG. 4 is an exploded view of the absorbent material on the exterior of the clean up bag.

On the exterior side 38 of the bag 12, there is padding fabric 40 which absorbs any liquid surrounding or contained in the excrement. The padding fabric 40 is illustrated in FIG. 4. The fabric shown is a corrugated cotton fabric which is often used in hospital settings; however, it will be appreciated by those skilled in the art that any type of absorbent fabric may be used.

The clean up device 10 is constructed by heat sealing the plastic glove 14 to one interior side 42 of the bag 12. In operation, the user places his or her hand inside the plastic glove 14 which is located on the inside 42 of the plastic bag 12. The user then grasps the excrement. The padding fabric 40 absorbs any moisture and thus, the specimen will not slip around. Further, the padding 40 prevents the user from feeling the texture and heat content of the excrement. After the user has picked up the excrement, the user will use its other hand to turn the plastic bag 12 inside out. The pleats 26 and 28 located on both sides 22 and 24 of the bag 12 facilitate the manipulation of the bag 12. When the bag 12 is turned inside out, the user can then remove his or her hand from the plastic glove 14 and grasp both ends of the draw strings 32 and 34 and tighten them so that the bag is closed. Thus, when complete, the excrement is contained on the interior of the bag.

What is claimed is:

1. A clean up device comprising:

a bag, said bag having a top and a bottom and a first and a second side, said first and second sides each having a pleat longitudinally extending from the top of the bag to the bottom of the bag;

a layer of absorbent material attached to the exterior side of the bag;

a glove being adapted for receiving either a left or right human hand, said glove being attached to one interior side of said bag; and a means for closing said bag, said means being located on the top of the bag.

2. A clean up device as defined in claim 1 wherein said bag is formed from heat-sealable plastic.

3. A clean up device as defined in claim 2 wherein said glove is formed from heat-sealable plastic.

4. A clean up device as defined in claim 3 wherein said absorbent material is a fibrous cotton or paper material attached to said exterior side.

5. A clean up device as defined in claim 4 wherein said closing means comprises two draw string cords.

* * * * *